US012246803B2

(12) United States Patent
Van Zanten

(10) Patent No.: US 12,246,803 B2
(45) **Date of Patent: *Mar. 11, 2025**

(54) COLLAPSIBLE SURFBOARD CASE

(71) Applicant: Dan Van Zanten, San Marcos, CA (US)

(72) Inventor: Dan Van Zanten, San Marcos, CA (US)

( * ) Notice: Subject to any disclaimer, the term of this patent is extended or adjusted under 35 U.S.C. 154(b) by 589 days.

This patent is subject to a terminal disclaimer.

(21) Appl. No.: 17/649,147

(22) Filed: Jan. 27, 2022

(65) Prior Publication Data

US 2023/0009827 A1 Jan. 12, 2023

Related U.S. Application Data

(63) Continuation-in-part of application No. 17/372,376, filed on Jul. 9, 2021, now Pat. No. 11,235,844.

(51) Int. Cl.
*B63B 32/80* (2020.01)
*B63B 32/87* (2020.01)

(52) U.S. Cl.
CPC ..... *B63B 32/80* (2020.02); *B63B 32/87* (2020.02)

(58) Field of Classification Search
CPC ..... A45C 7/0031; B63B 32/80; B63B 32/87
See application file for complete search history.

(56) References Cited

U.S. PATENT DOCUMENTS

| | | | | |
|---|---|---|---|---|
| 5,470,956 | A | 11/1995 | Hayashi et al. | |
| 7,077,266 | B2 | 7/2006 | Dietrich | |
| 8,066,138 | B2 | 11/2011 | Boyles | |
| 8,381,930 | B2 | 2/2013 | Boyles | |
| 11,235,844 | B1 * | 2/2022 | Van Zanten | A45C 7/0031 |
| 2004/0232016 | A1 | 11/2004 | Dietrich | |
| 2007/0183693 | A1 | 8/2007 | Malloy | |
| 2018/0132584 | A1 * | 5/2018 | Boyles | B63B 32/80 |

FOREIGN PATENT DOCUMENTS

WO WO-2017068369 A2 4/2017

* cited by examiner

*Primary Examiner* — Andrew Polay
(74) *Attorney, Agent, or Firm* — Eversheds Sutherland (US) LLP; Nicola A. Pisano; Emma Hawley

(57) ABSTRACT

A collapsible protective case for transporting or storing one or more surfboards, the protective case having a rigid, impact-resistant outer surface, a housing and a plurality of adjoining nested sections that are selectively configurable between a collapsed, fully nested position within the housing and an extended position, the protective case including a space configured to accommodate, in the extended position, the surfboard fins.

22 Claims, 7 Drawing Sheets

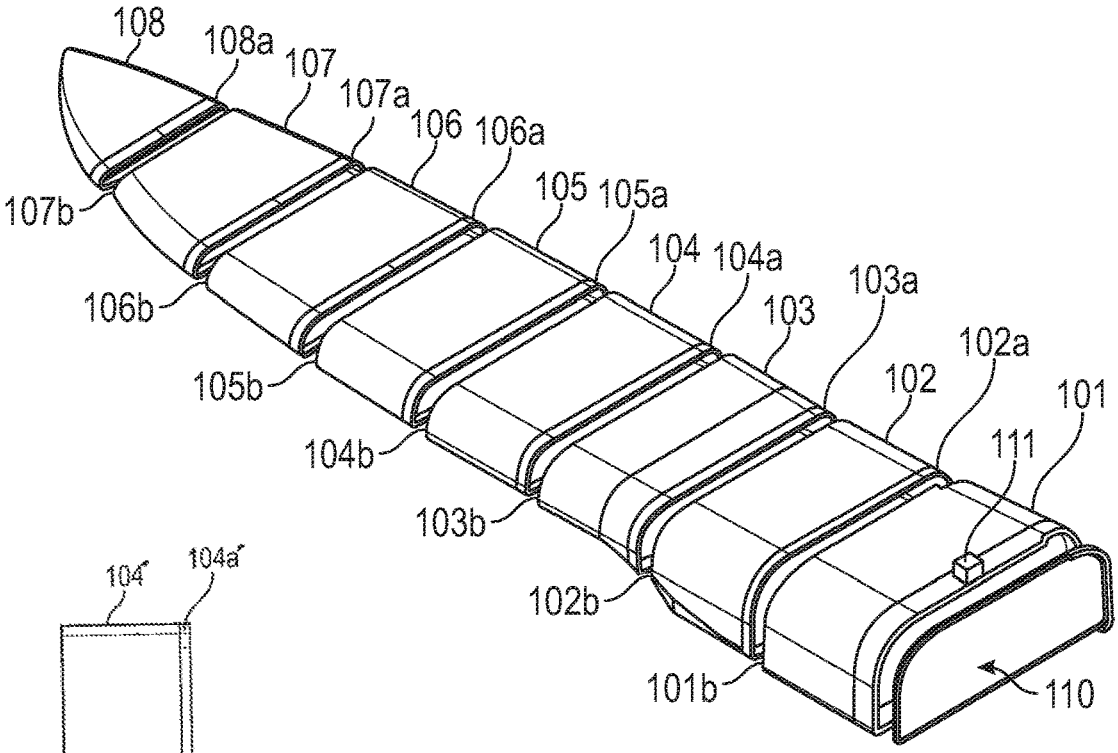
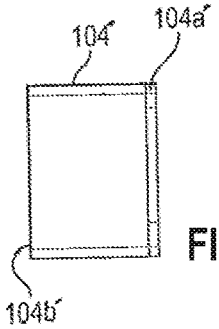
FIG. 2D
FIG. 2A
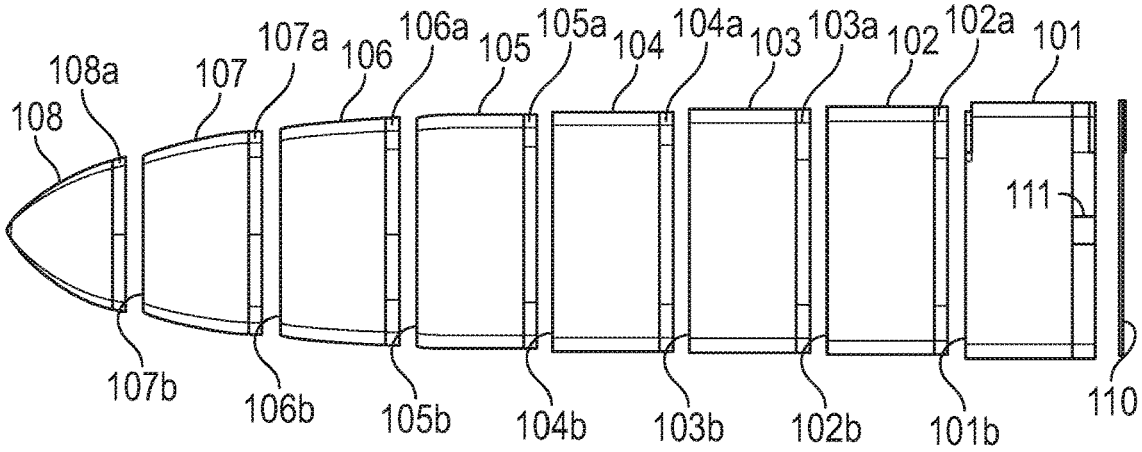
FIG. 2B
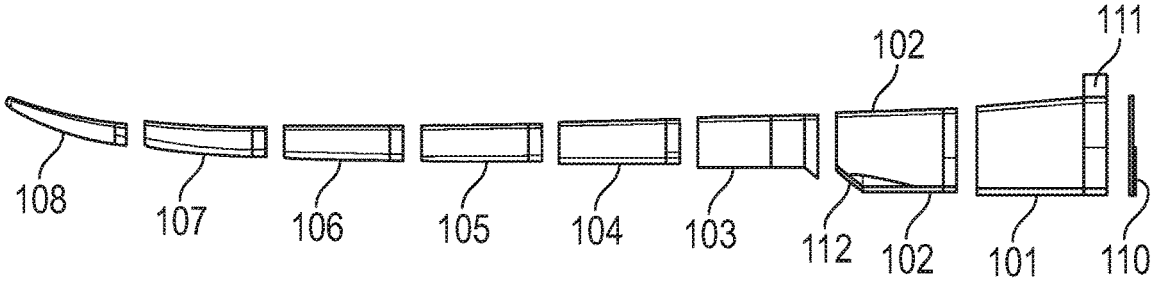
FIG. 2C

COLLAPSIBLE SURFBOARD CASE

CROSS-REFERENCE TO RELATED APPLICATIONS

This application is a continuation-in-part of U.S. patent application Ser. No. 17/372,376, filed Jul. 9, 2021, now U.S. Pat. No. 11,235,844, issued Feb. 1, 2022, the entire contents of which are incorporated herein by reference.

FIELD OF THE INVENTION

The present invention relates generally to a collapsible, telescoping hard case for protectively transporting one or more surfboards.

BACKGROUND OF THE INVENTION

Protective cases for surfboards, golf clubs and other sports equipment generally are known. By way of example, published U.S. Patent Application Publication No. 2004-0232016 and U.S. Pat. No. 7,077,266, both to Dietrich, describe telescoping hard cases for carrying golf bags, U.S. Pat. No. 5,470,956 to Peckenpaugh, Sr., describes a telescoping storage case for fishing poles or skis, and U.S. Pat. Nos. 8,066,138 and 8,381,930, both to Boyles, describe telescoping travel cases for surfboards.

Surfboards generally range in length from 6-10 feet, in width between about 2-3 feet, and in depth about 3 inches, and often are difficult to transport, even over relatively short distances.

Surfboards typically are stored in soft-sided bags or "socks" and generally are susceptible to damage, such as nicks and dents, while being transported from a surfer's home to the beach. Such minor cosmetic damage, and often much more severe damage, can be sustained to the surfboard during travel to remote destinations, e.g., especially when shipping a surfboard through via commercial aviation. In many cases, incidental damage to a surfboard during travel and/or transportation makes a surfboard much less aesthetically pleasing, an important consideration, as high-end surfboards can cost upwards of several thousands of dollars.

One previously-known commercially available rigid surfboard case, offered by Santa Monica Hard Case in California, USA, is formed of a flexible plastic that leaves the boards vulnerable to damage during transport or shipment. Also, that product is offered with limited size options and features, and cannot be transitioned to a reduced size when not in use.

A coating of surfer's wax typically is applied to the upper surface of a surfboard to improve the surfer's footing on the board when in use. When the surfboard is later inserted into a conventional soft-sided surfboard case, the wax can stick to the interior surface of the case, enhancing the difficulty in inserting the surfboard into, and later removing the surfboard from, the soft-sided case. In addition, such cases provided very little protection to the fins that extend from the rear surface of the surfboard, often leading to bending or other accidental damage to the surfboard fins.

In view of the foregoing, there is a need for a protective case for surfboards that also provides for convenient storage when not in use, and that accommodates and protects the surfboard fins against damage during transport.

SUMMARY OF THE INVENTION

In accordance with the principles of the present invention, a protective case for surfboards is provided that enhances ease with which the surfboard can be inserted and removed from the case, and further, that accommodates and protects the fins on the rear surface of the surfboard. Further in accordance with the present invention, the case includes a housing and a plurality of nested sections configured to transition between an extended mode suitable for completely covering a surfboard, and a collapsed mode for storage when not in use, wherein the plurality of nested sections is fully nested within the housing. Preferably, the nested sections that cover the forward portion of a surfboard in the extended mode are sequentially tapered to generally approximate the contour of the forward portion of most surfboards.

At least the housing of the collapsible protective surfboard case is constructed of a rigid, impact-resistant material, such as a multilayer polycarbonate material. The plurality of nested sections preferably also is constructed of rigid impact-resistant material, or alternatively may comprise wire frames covered by a light, flexible material, such as ballistic nylon. In accordance with some embodiments, the nested sections may be reversibly disconnected to permit additional sections to be incorporated within, or removed from, the case to lengthen or shorten the case to accommodate different surfboard lengths. At least some of the nested sections having longer or shorter lengths and may be substituted for existing sections to increase or decrease the overall length of the case. The housing and nested sections also may be dimensioned to accommodate two surfboards stacked one atop another, with tailfins removed.

Preferably, the housing includes front and rear caps that may be removably detached from the housing, when the case is not in use, to retain the plurality of nested sections fully within the housing. The end caps may include one or more latches for engaging the end caps to the housing. The housing also may include a handle disposed on its exterior surface for conveniently carrying the case, when in the collapsed mode. In alternative embodiments, one or both endcaps may be affixed to the housing via hinges, and/or include wheels and handles for facilitating travel over pavement or flooring, such as in airports.

In accordance with another aspect of the present invention, an outermost section, disposed between the housing and an adjoining one of the plurality of nested sections includes a ramp along a frontal portion that defines a reduced opening, through which the adjoining one of the plurality of nested sections extends in the extended mode. Preferably, the housing together with the outermost section provided a volume sufficient to accommodate fins disposed on the rear portion of a surfboard, to protect the fins from damage during transport. One or more form removable blocks may be provided to cushion the fins when a surfboard is disposed within the case. Alternatively, the housing may provide adequate space, when the plurality of nested sections is in the extended mode, to accommodate the fins after being removed from the surfboard.

These and other aspects of the present invention will become apparent to those skilled in the art after a reading of the following description of the preferred embodiment when considered with the drawings, as they support the claimed invention.

BRIEF DESCRIPTION OF THE DRAWINGS

FIGS. 2A, 2B, 2C and 2D are, respectively, exploded rear perspective view, exploded plan view and exploded elevation view of the surfboard case of FIG. 1, and a plan view of a replacement section 104' for use in lengthening the case.

DETAILED DESCRIPTION OF THE INVENTION

Referring now to FIGS. 1A to 1C and 2A to 2C, an exemplary embodiment of the present invention is described. The present invention provides a protective case for surfboards, which is configured to be used in a fully deployed mode for completely protectively containing a surfboard, and to be alternatively collapsed to a storage mode when not in use, i.e., when the surfboard is not stored therewithin. More particularly, the present invention includes a collapsible protective case for surfboards with a housing constructed of an impact-resistant material outer surface, such as multilayer polycarbonate, which is both lightweight and rigid, especially when the plurality of adjoining sections is transitioned to an expanded transport configuration.

Preferably, the rigid, impact-resistance outer surface is formed from a hard plastic or composite material that is sufficiently thick to prevent puncture or tearing, resist pressure, flexing or deformation, such that the surfboard contained completely within the housing is protected from any external forces.

Figure 1A:
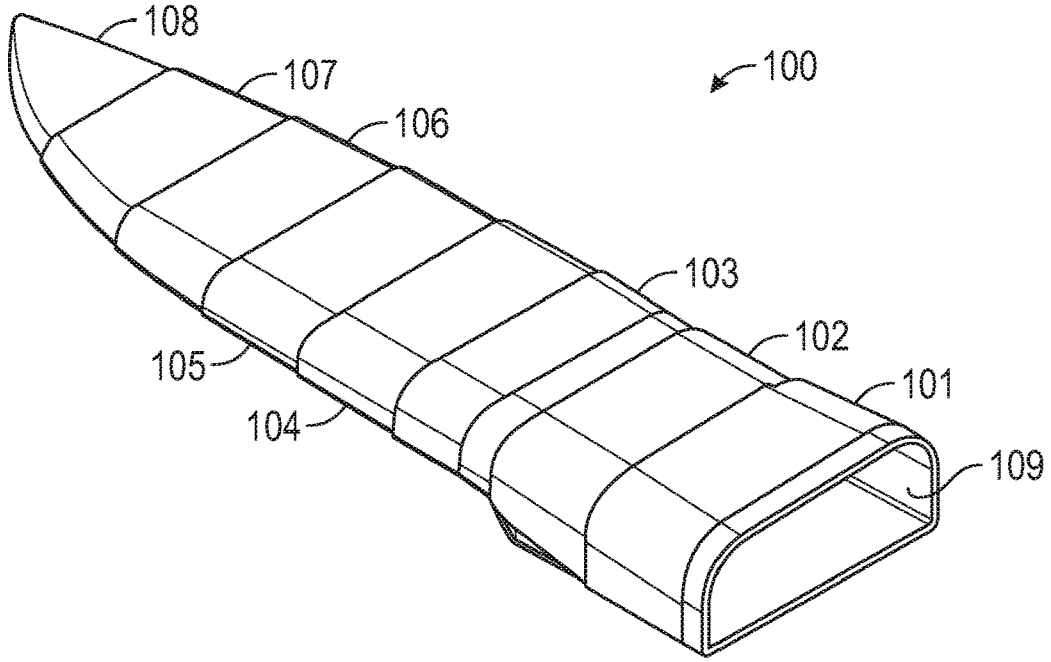
FIGS. 1A, IB and IC are, respectively, a rear perspective view, plan view and elevation view of a surfboard case in an extended mode according to one embodiment of the present invention.
Figure 1B:
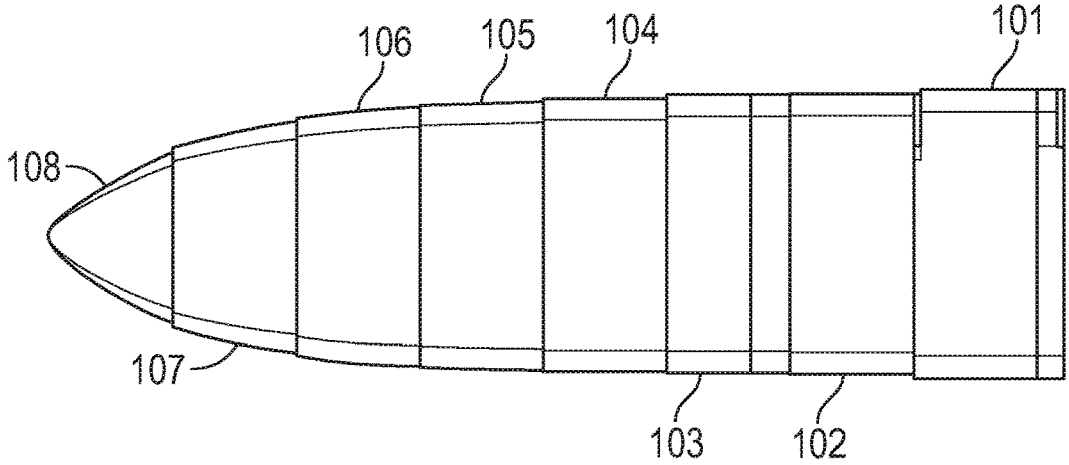
Figure 1C:
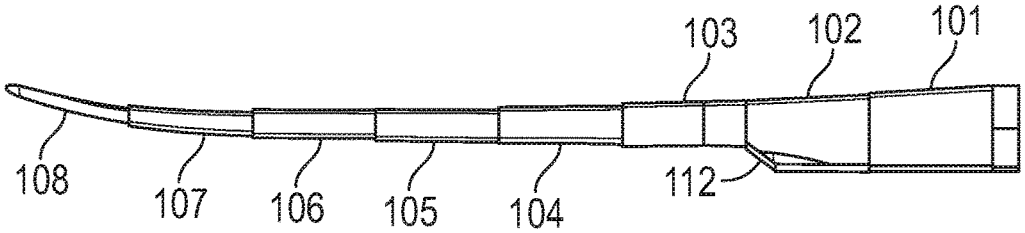

Referring to FIGS. 1A-1C, case 100 comprises housing 101 and illustratively includes plurality of sections 102, 103, 104, 105, 106, 106 and 108 configured to telescopically nest within adjoining sections. Section 102, the outermost section, is configured to nest fully within housing 101. As will be generally understood for telescoping sections, the sections include features that interengage with adjoining proximal and distal sections when case 100 is in the extended configuration. More specifically, referring to FIGS. 2A to 2C, each of sections 102-108 has an enlarged feature, e.g., 102*a*, 103*a*, 104*a*, 105*a*, 106*a*, 107*a*, 108*a*, at its proximal edge that engages a corresponding lip, e.g., 101*b*, 102*b*, 103*b*, 104*b*, 105*b*, 106*b*, and 107*b* disposed on the distal edge of the proximal adjoining section, such that the enlarged features interengage the lips of the proximal adjoining section when the case is in its extended configuration. In an alternative embodiment, and as will be apparent to one of skill in the art of telescopic designs, the enlarged features and lips may be transposed between housing 101 and adjoining sections 102-107.

In FIG. 2D, exemplary replacement nested section 104' is depicted. Should the user which to lengthened the case, for example, to cover a longer surfboard, the user could disassemble the plurality of nested sections and substitute replacement section 104' for original section 104, addition several inches to the case length. As will be appreciated, any number of nested sections may be swapped out for longer or shorter nested sections to lengthen or to decrease the overall length of the case. As a yet further alternative, additional nested sections having the same length as the existing nested sections reversibly may be incorporated into the case to adjust the length for longer or shorter surfboards.

Section 108 has no lip at its distal edge because the innermost nesting section 108 forms a closed nose cone. As also depicted in FIGS. 1A and FIGS. 2A to 2C, the top, bottom, and sidewalls of housing 101 form rear opening 109 through which a surfboard may be inserted into case 100 when in the extended configuration. Rear end cap 110 may be removably fastened to the proximal end of housing 101 to cover rear opening 109 using latching mechanism 111, e.g., buckle, hook and pile strap, etc. As a further alternative, rear end cap 110 may be affixed to housing 101 via hinges instead a latching mechanism.

In accordance with one aspect of the invention, distal portion of outermost section 102 includes upward ramping front wall 112 along its distal edge, which defines a reduced frontal opening area in outermost section 102 through which adjoining section 103 extends when the case is in its extended configuration. Upward ramping wall 112 creates sufficient volume within outermost section 102 so that, together with the volume within housing 101, outermost section 102 and housing 101 can accommodate fins extending from the underside of the rear portion of a surfboard to fully enclose and protect the fins during transport.

As illustrated in the figures, at least sections 105, 106, 107 and 108, which cover a forward portion of the surfboard, may be laterally and vertically tapered to approximate the contours of popular surfboard shapes.

Figure 3A:
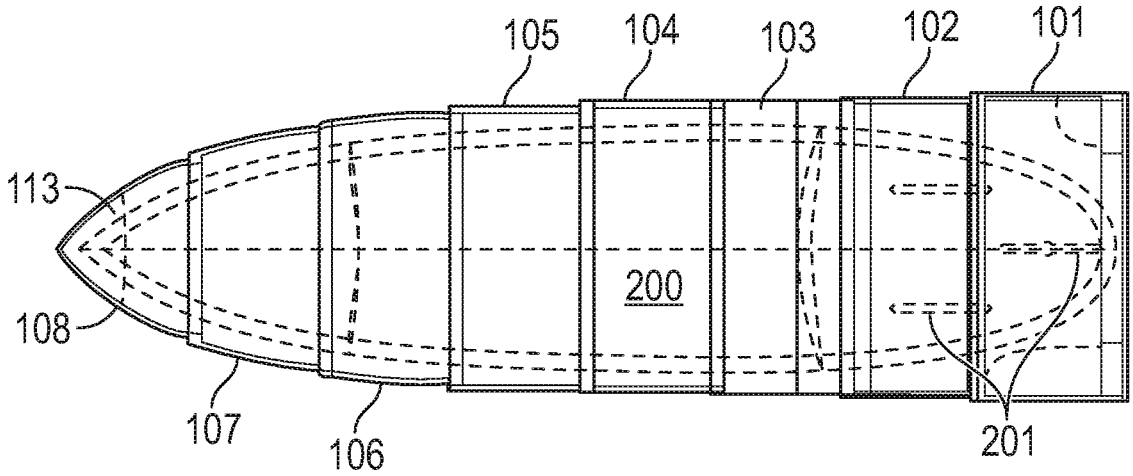
FIGS. 3A and 3B are, respectively, a plan view and side elevation view showing a conventional surfboard disposed with then surfboard case of FIGS. 1 and 2.
Figure 3B:
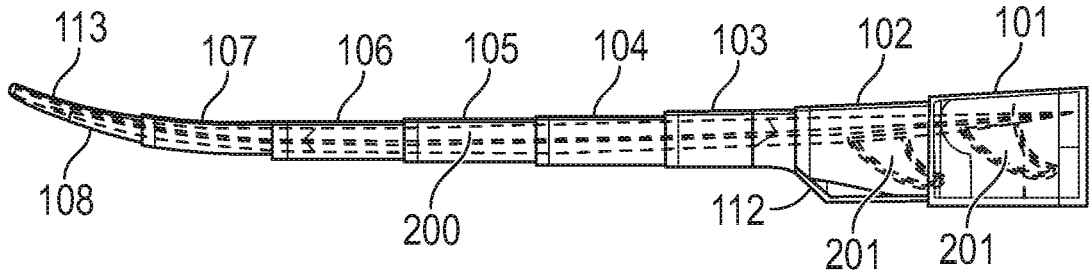

Referring now to FIGS. 3A and 3B, housing 101 and plurality of nested sections 102-108 of case 100 are shown as wireframe outlines in the extended configuration with an exemplary surfboard 200 disposed within case 100. As described above, distal sections of the case, e.g., sections 105 to 108 approximately conform to the lateral and vertical shape of surfboard 200 to prevent the surfboard from sideways or vertical movement within the case, while the space created by outermost section 102 and housing 101 provides sufficient height to accommodate the fins 201 of the surfboard without crushing or bending. Additionally, foam block 113 may be provided in within section 108 to engage the forward end of surfboard 200 to prevent damage to the nose of the surfboard. Removable foam blocks (not shown) may be inserted between the rear underside of surfboard 200 and the bottom surface of housing 101 to cushion fins 201. Additional removable foam blocks (not shown) may be inserted between the rear topside of surfboard 200 and the top wall of housing 101 to prevent vertical movement of the rear portion of the surfboard during transport.

Figure 4:
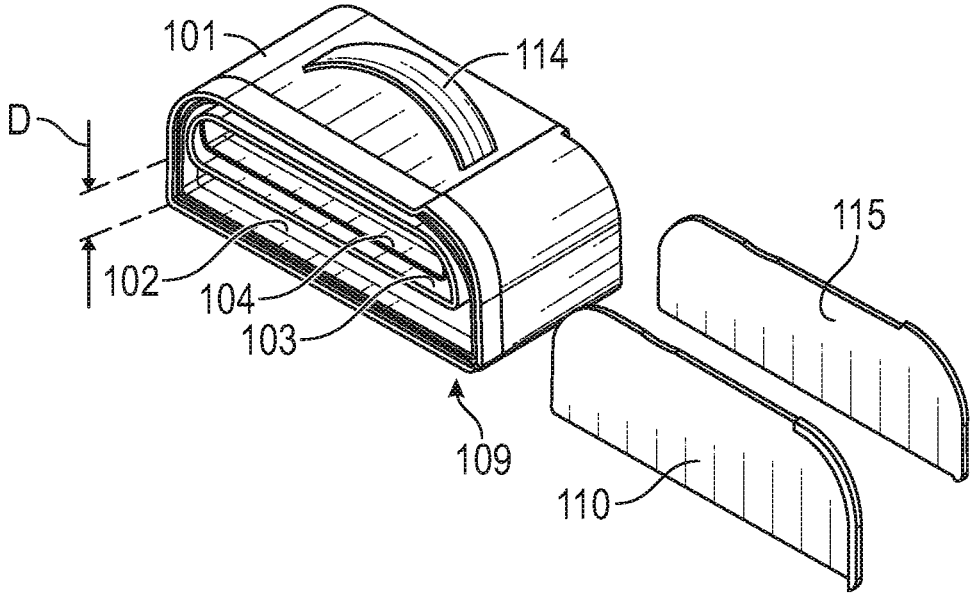
FIG. 4 is a perspective rear view of the surfboard case of FIGS. 1 and 2, in the collapsed mode, with the front and rear end caps displaced laterally.

Referring now to FIG. 4, case 100 is described in a collapsed configuration. In the collapsed configuration, each of sections 102 to 108 fully nests within the proximal adjoining section, i.e., section 108 nests within section 107, section 107 nests within section 106, section 106 nests within section 105, section 105 nests within section 104, section 104 nests within section 103, section 103 nests within section 102, and section 102 nests within housing 101. As shown in FIG. 4, upwardly ramped wall 112 of section 102 causes section 103 to nest at a position spaced apart from the bottom wall of section 102 by a distance D, which spacing provides the additional volume in section 102 and housing 101 to accommodate surfboard fins 201 when the case is transitioned to the extended configuration. Also shown in FIG. 4 is optional handle 114, which may be coupled to housing 101 to facilitate carrying of the case when not in use, i.e., in the collapsed configuration.

Still referring to FIG. 4, rear cap 110 and front cap 115 are described. As discussed above, rear cap 110 may be fastened to over rear opening 109 to fully enclose a surfboard when the case is in the extended configuration to retain the surfboard within the case. Rear end cap 110 may be fastened over rear opening 109 and front cap 115 also may be fastened to front of housing 101 to retain nested sections 102-108 within the housing when it is not in use.

Optionally, a detachable carrying strap may be fastened to the exterior of case 100, using suitable fasteners, not shown, when case 100 is in the extended configuration to facilitate carrying of the case when in use. Preferably, housing 101 has a depth from front to rear of about 12 inches, a height from top to bottom of about 9 inches, and a width from side to side of about 24 inches. Other modifications and improvements will occur to those skilled in the art upon reading the description provided herein. For example, the depth of housing 101 may be increased, e.g., from 12 inches to 18 inches or more, to provide additional volume to accommodate the surfboard fins or other surfing equipment. In this case, ramp 112 of outermost section 102 may be incorporated directly into the forward wall of the housing 101, and proximal 102*a* and distal edge 102*b* of outermost section 102 configured similarly to the other sections.

Figure 5A:
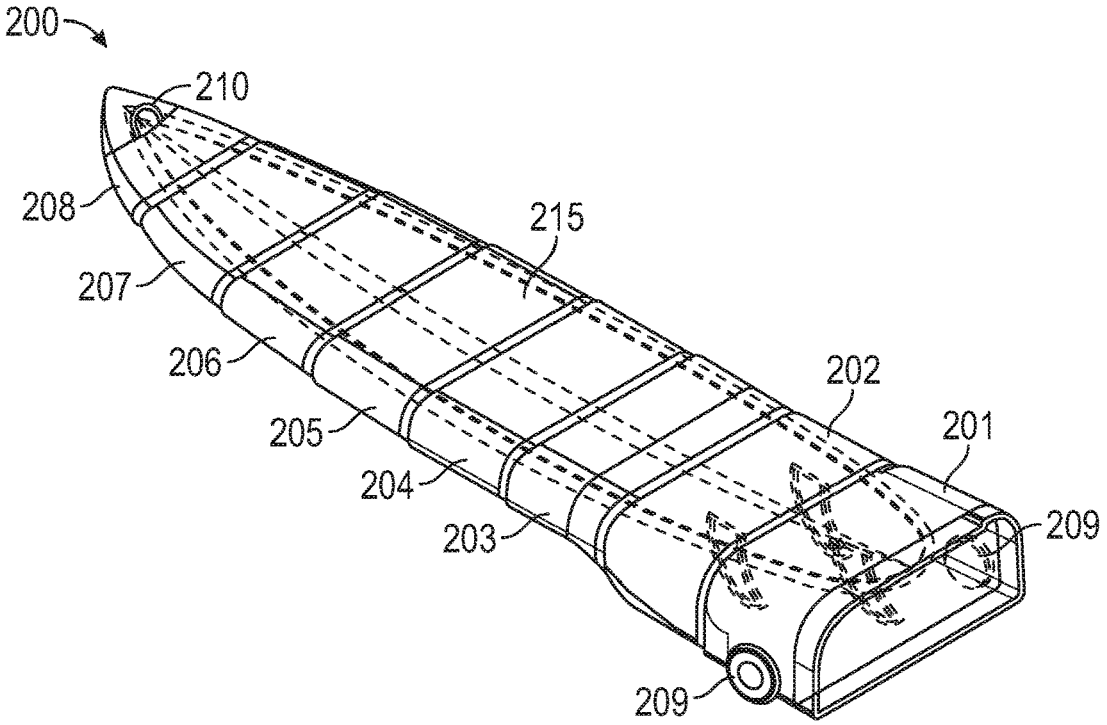
FIGS. 5A, 5B and 5C are, respectively, a rear perspective view, plan view and elevation view of an alternative embodiment of a surfboard case of the present invention in an extended mode.
Figure 5B:
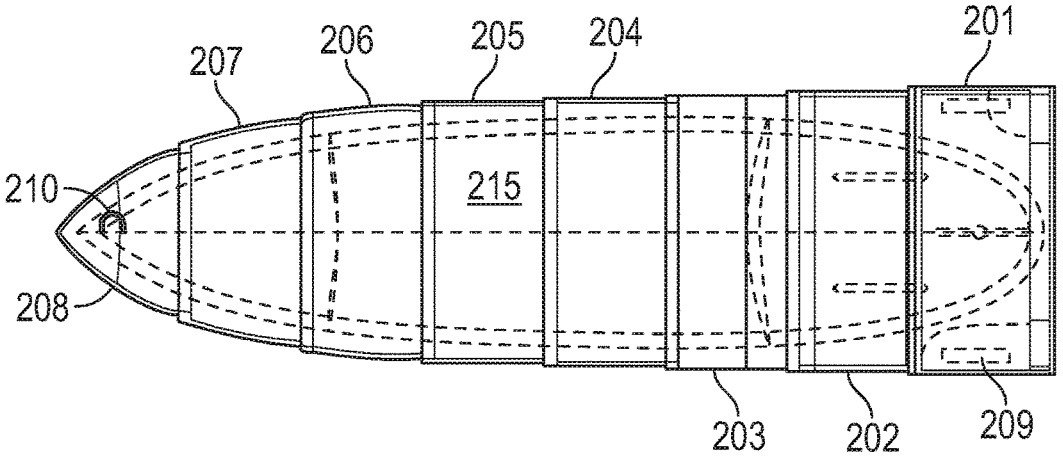
Figure 5C:
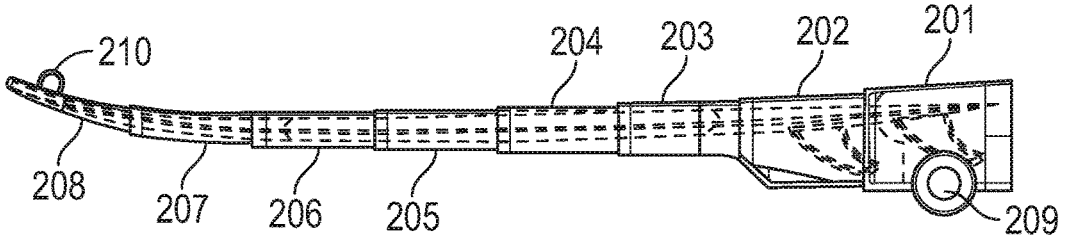
Figure 6A:
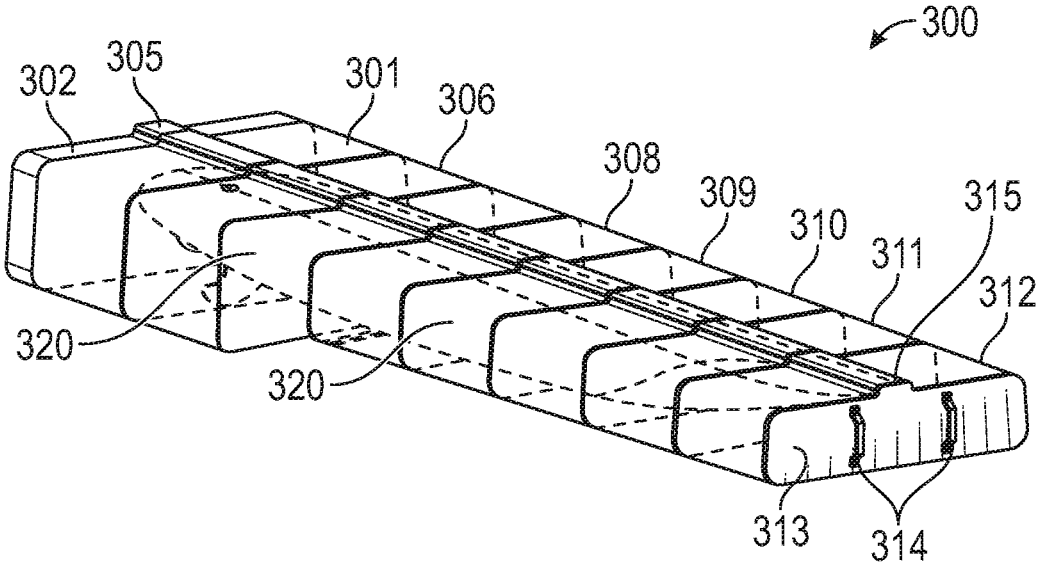
FIGS. 6A and 6B are, respectively, front and rear perspective views of another embodiment of the surfboard case of the present invention in an extended mode.
Figure 6B:
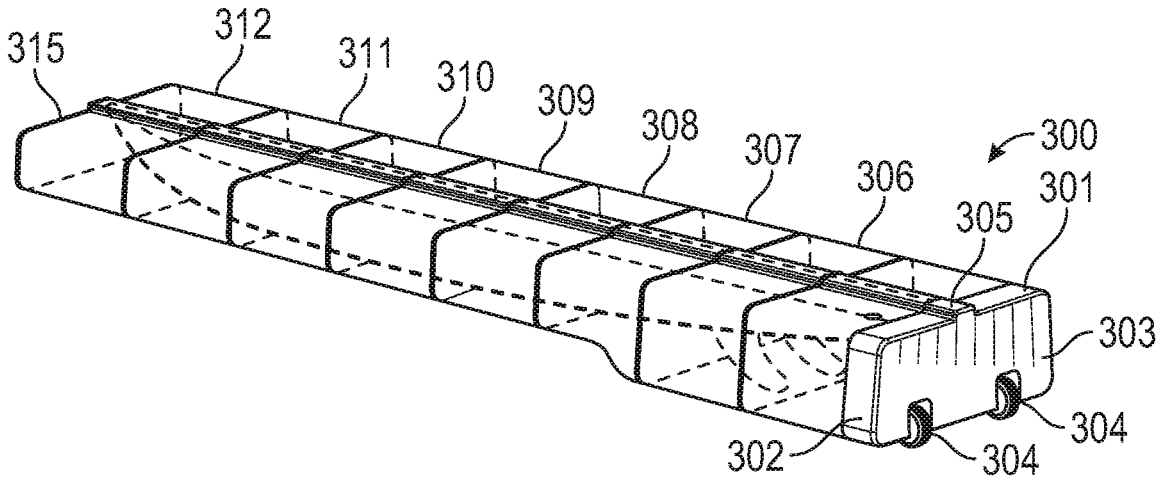
Figure 7A:
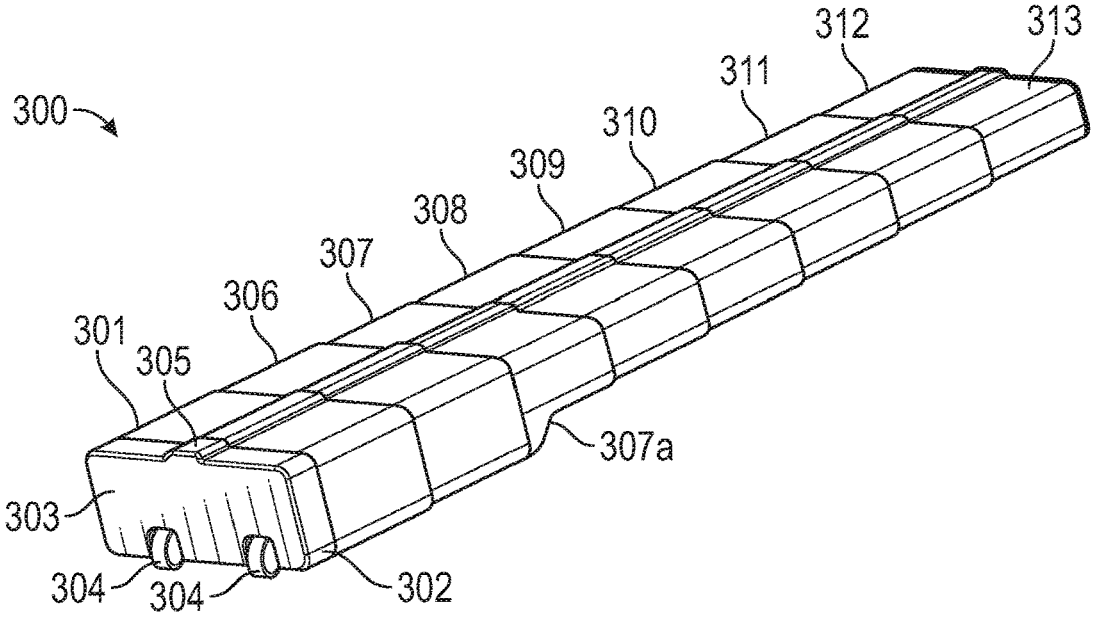
FIGS. 7A, 7B and 7C are, respectively, a rear perspective view, elevation view and plan view of the surfboard case of FIGS. 6A and 6B.
Figure 7B:
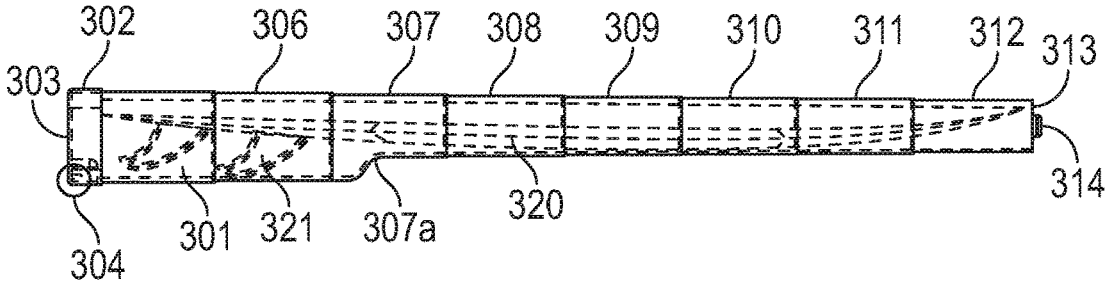
Figure 7C:
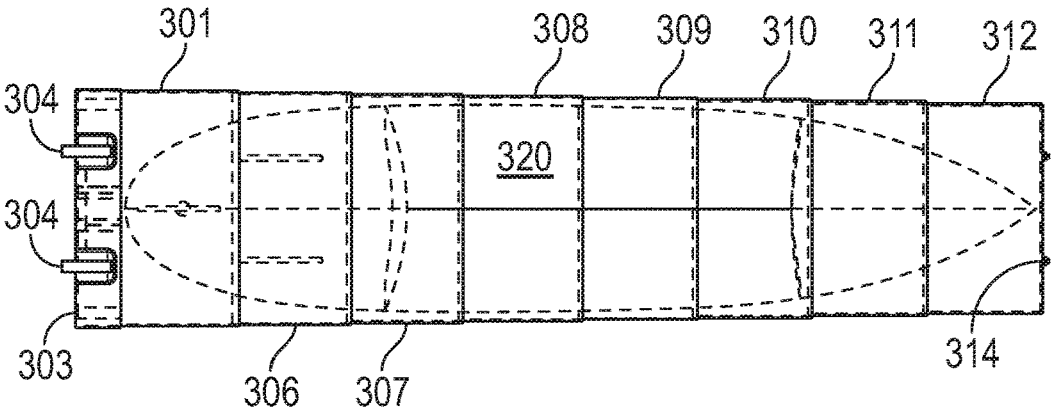

Referring now to FIGS. 5A to 5C, an alternative embodiment of the surfboard case of the present invention is described. Case 200 includes housing 201, and plurality of nested sections 202 to 208, which are configured to telescope within one another and housing 201. Wheels 209 are disposed on housing 201 and handle 210 is disposed on nested section 208 so that when the case is fully extended to cover surfboard 215, handle 210 may be used to tow case 200 with wheels 209, for example, while transiting an airport. Like the embodiment of FIGS. 1 and 2, case 200 could be lengthened or shortened by replacing one or more of the plurality of nested sections with longer or shorter nested sections similar to section 104' depicted in FIG. 2D. Such a replacement could be performed, for example, by pushing the plurality of nested sections through the rear opening, disassembling the sections, and substituting selected sections with longer or shorter sections.

Figure 8A:
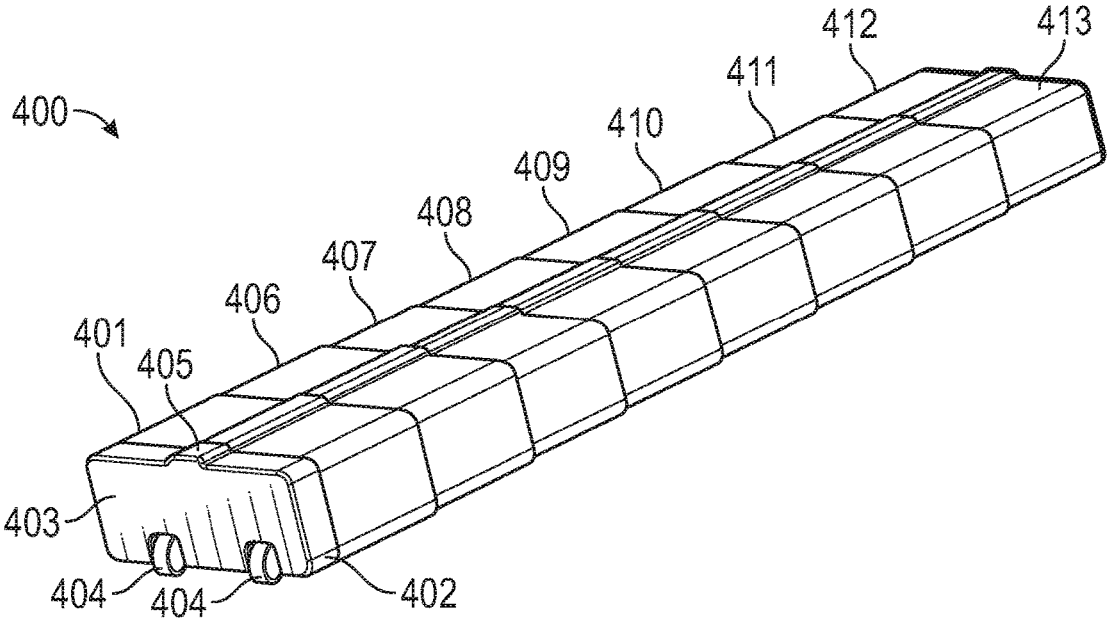
FIGS. 8A, 8B and 8C are, respectively, a rear perspective view, elevation view and plan view of a further alternative embodiment of the surfboard case of the present invention in an extended mode.
Figure 8B:
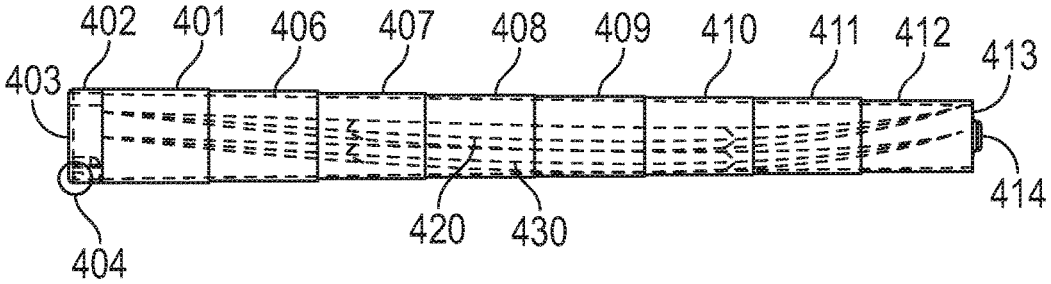
Figure 8C:
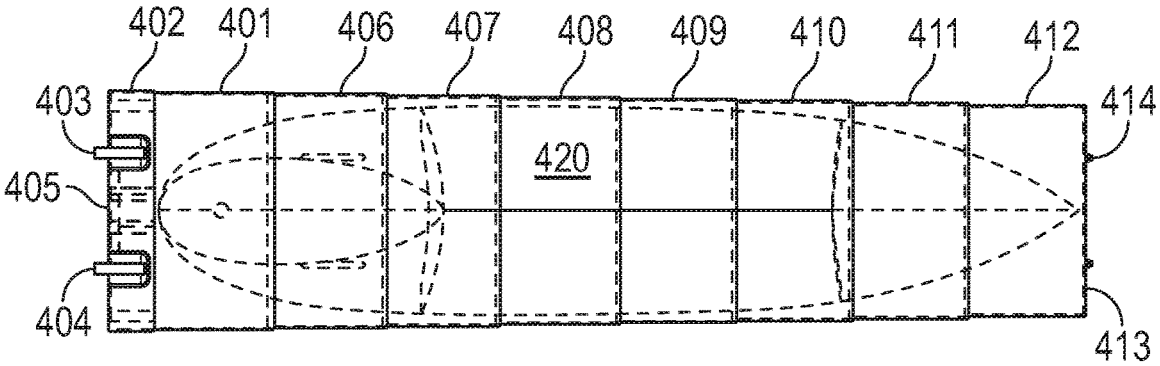

FIGS. 6A, 6B and 7A tO 7C depict a further alternative embodiment of the telescoping case of the present invention containing surfboard 320. In particular, case 300 includes housing section 301 including frame 302 that carries hinged hatch 303, wheels 304 and latching mechanism 305. Case 300 also includes plurality of nested sections 306 through 312, including end cap 313 that includes handles 314 for towing the case and latching mechanism 315. Case 300 differs from the embodiments discussed earlier in that the plurality of nested sections generally in that nested sections 306 to 312, other than section 307 (see FIGS. 7) have a generally rectangular shape and are not tapered along the longitudinal axis, other than to provide telescoping and nesting of adjacent sections. In this case, the overall length of case 300 could be extended or shortened by adding an additional innermost section or by removing section 312. In addition, nested section 307 preferably includes transition region 307*a* that couples the section 306, which has a larger opening, to section 308, which has a smaller opening, to provide sufficient interior volume in housing 301 and 306 to accommodate fins 321 of surfboard 320, Referring now to FIGS. 8A to 8C, a further alternative embodiment of the inventive telescoping surfboard case is disclosed. Telescoping case 400 of FIGS. 8A to 8C is similar to the embodiment of FIGS. 6 and 7, except that case 400 is configured to hold two surfboards stacked one atop another. Case 400 includes housing 401 having frame 402 that carries hinged hatch 403, wheels 404 and latching mechanism 405. Case 400 also includes plurality of nested sections 406 through 412, including end cap 413 that includes handles 414 for towing the case and latching mechanism 415. In this embodiment, section 407 does not include a transition section 307*a* as in the prior embodiment of embodiments 6 and 7. Accordingly, case 400 has sufficient depth along its longitudinal axis in the extended mode to accept two stacked surfboards, 420 and 430, from which the fins have been removed. The separated fins may be stored in the additional free volume provided in outermost section 401 or innermost section 412.

The above mentioned examples are provided to serve the purpose of clarifying the aspects of the invention and it will be apparent to one skilled in the art that they do not serve to limit the scope of the invention.

What is claimed is:

1. A protective case for a surfboard comprising:

a rectangular housing defining a rear opening and a front opening;

a plurality of nested sections slidably arranged within the housing to transition from a collapsed position, wherein the plurality nested sections fully nest within the housing, to an extended configuration, wherein the plurality of nested sections telescopically extend from the front opening and interengage to define an elongated volume sufficient to accommodate a surfboard;

wherein a case defines a space sufficient to accommodate fins disposed on the surfboard when the plurality of nested sections is in the extended configuration.

2. The protective case of claim 1 wherein the elongated volume is sufficient to accommodate two surfboards.

3. The protective case of claim 1, wherein at least some of the plurality of nested sections are tapered.

4. The protective case of claim 1, further comprising a rear cap configured to cover the rear opening.

5. The protective case of claim 1, further comprising at least one latch configured to engage the rear cap to the housing.

6. The protective case of claim 5, further comprising a front cap configured to retain the plurality of nested sections within the housing.

7. The protective case of claim 1, further comprising a carrying handle disposed on the housing.

8. The protective case of claim 1, further comprising wheels disposed on the housing.

9. The protective case of claim 1, wherein the housing and the plurality of nested sections comprise an impact-resistant material.

10. The protective case of claim 1, wherein the plurality of nested sections is configured to permit removal of at least one nested section, or addition of a further nested section, to shorten or lengthen an overall length of the protective case.

11. The protective case of claim 1, further comprising at least one foam block disposed in the housing to cushion a surfboard when inserted into the protective case when the plurality of nested sections is in the extended configuration.

12. A protective case for a surfboard comprising:

a housing defining a rear opening and a front opening, the housing having a depth of between 12 and 18 inches between the front opening and the rear opening;

a plurality of nested sections slidably arranged to transition within the housing to transition from a collapsed configuration, wherein the plurality nested sections fully nest within the housing, to an extended configuration, wherein the plurality of nested sections extend telescopically through the front opening and interengage to define a volume sufficient to accommodate a portion of a surfboard;

wherein the case defines a space to accommodate fins disposed on the surfboard when the plurality of nested sections is in the extended configuration.

13. The protective case of claim 11 wherein the volume is sufficient to accommodate two surfboards.

14. The protective case of claim 11, wherein at least some of the plurality of nested sections are tapered.

15. The protective case of claim 11, further comprising a rear cap configured to cover the rear opening.

16. The protective case of claim 15, further comprising at least one latch configured to engage the rear cap to the housing.

17. The protective case of claim 11, further comprising a front cap configured to retain the plurality of nested sections within the housing.

18. The protective case of claim 11, further comprising a carrying handle disposed on the housing.

19. The protective case of claim 11, wherein the housing and the plurality of nested sections comprise an impact-resistant material.

20. The protective case of claim 11, further comprising wheels disposed on the housing.

21. The protective case of claim 11, wherein the plurality of nested sections is configured to permit removal of at least one nested section, or addition of a further nested section, to shorten or lengthen an overall length of the protective case.

22. The protective case of claim 11, further comprising at least one foam block disposed in the housing to cushion a surfboard when inserted into the case when the plurality of nested sections is in the extended configuration.

* * * * *